US008283543B2

(12) United States Patent
McBain

(10) Patent No.: US 8,283,543 B2
(45) Date of Patent: Oct. 9, 2012

(54) BASS DRUM SUPPORT SYSTEM

(76) Inventor: Duncan McBain, Toronto (CA)

( * ) Notice: Subject to any disclaimer, the term of this patent is extended or adjusted under 35 U.S.C. 154(b) by 0 days.

(21) Appl. No.: 13/130,385

(22) PCT Filed: Nov. 21, 2008

(86) PCT No.: PCT/CA2008/002048

§ 371 (c)(1),
(2), (4) Date: May 20, 2011

(87) PCT Pub. No.: WO2010/057287

PCT Pub. Date: May 27, 2010

(65) Prior Publication Data

US 2011/0219938 A1 Sep. 15, 2011

(51) Int. Cl.
*G10D 3/00* (2006.01)

(52) U.S. Cl. ..... 84/411 R

(58) Field of Classification Search ..... 84/411 R, 84/421

See application file for complete search history.

(56) References Cited

U.S. PATENT DOCUMENTS

| | | | | |
|---|---|---|---|---|
| 923,610 | A | 6/1909 | Wanamaker | |
| 1,330,814 | A | 2/1920 | Meyer | |
| 1,416,522 | A | 5/1922 | Straight | |
| 2,971,738 | A | 2/1961 | Way | |
| 4,158,980 | A | 6/1979 | Gauger | |
| 4,870,883 | A * | 10/1989 | Gauger | 84/413 |
| 5,272,952 | A | 12/1993 | Hoshino | |
| 5,309,811 | A | 5/1994 | Hoshino | |
| 5,337,645 | A | 8/1994 | Johnston | |
| 5,454,288 | A | 10/1995 | Hoshino | |
| 5,477,767 | A | 12/1995 | May | |
| 5,998,717 | A | 12/1999 | Chen | |

FOREIGN PATENT DOCUMENTS

JP 03111895 A2 5/1991

OTHER PUBLICATIONS

International Search Report for PCT/CA2008/002048 dated Aug. 12, 2009.

* cited by examiner

*Primary Examiner* — Kimberly Lockett
(74) *Attorney, Agent, or Firm* — Buchanan Ingersoll & Rooney PC

(57) ABSTRACT

A bass drum support hoop for supporting one or more percussive instruments, and a method of supporting one or more percussive instruments, above a bass drum. The hoop comprising: an inward face, an outward face, a front edge, and a drum head edge adapted to engage a drum head; the hoop adapted to receive a plurality of tensioners opposite the drum head edge and at least one percussive instrument support for mounting at least one percussive instrument; the hoop capable of supporting the at least one percussion instrument above the outward face; whereby when the hoop is tensioned by the tensioners attached to a bass drum shell to apply pressure to the drum head positioned across the bass drum shell and in contact with the drum head edge, the hoop is capable of supporting the at least one percussive instrument support, and the at least one percussive instrument mounted on the support and positioned above the outward face of the hoop, while maintaining substantially uniform axial pressure against the drum head and not applying substantial radial pressure against the drum shell.

9 Claims, 8 Drawing Sheets

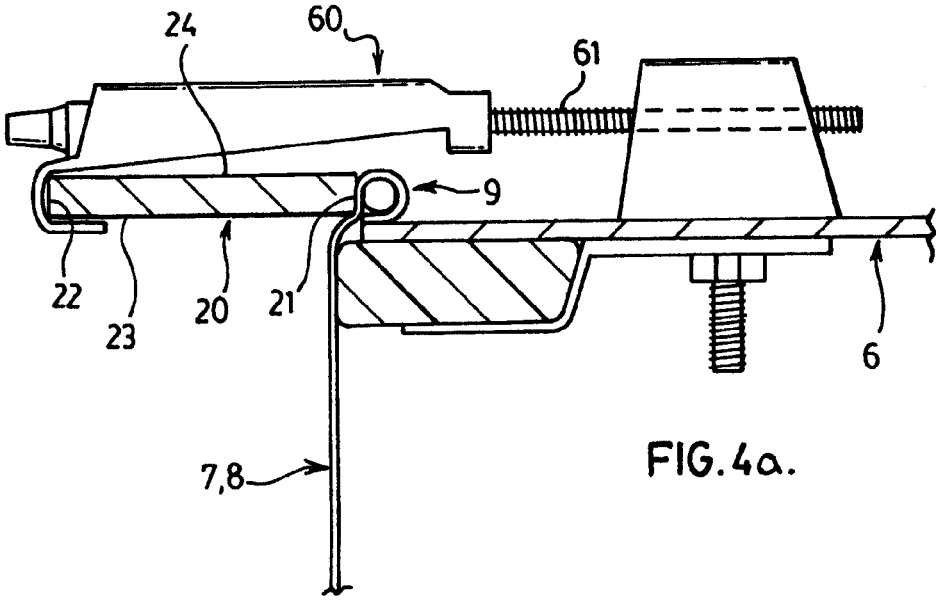
FIG. 4a.
FIG. 5.
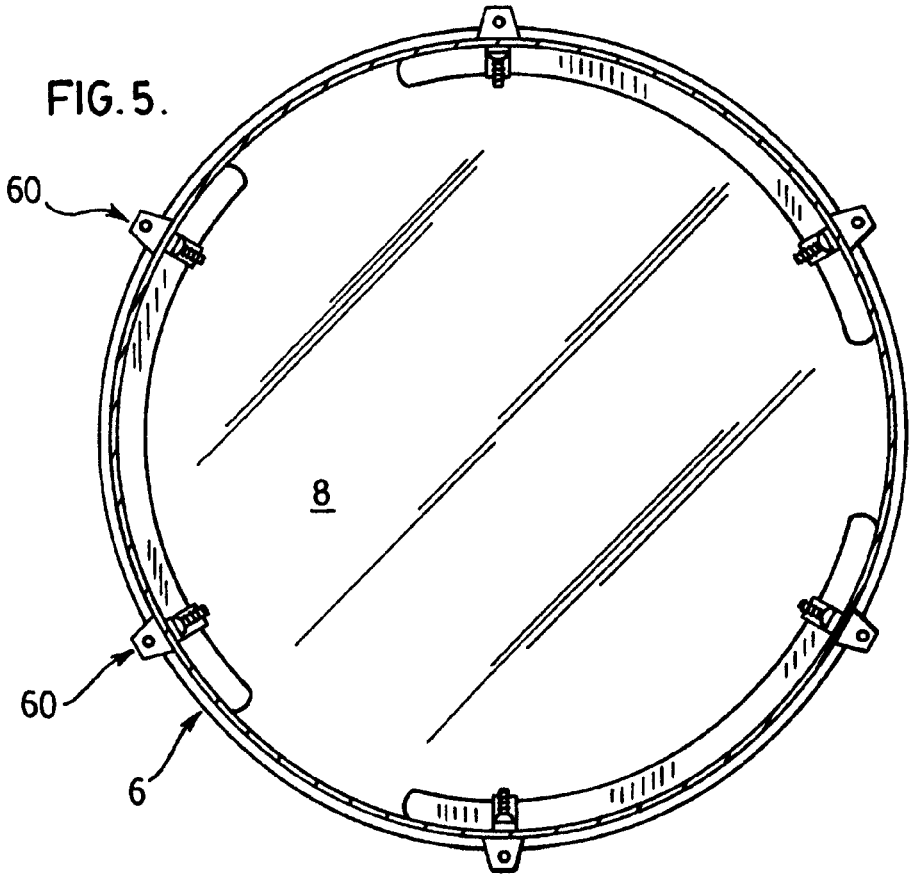

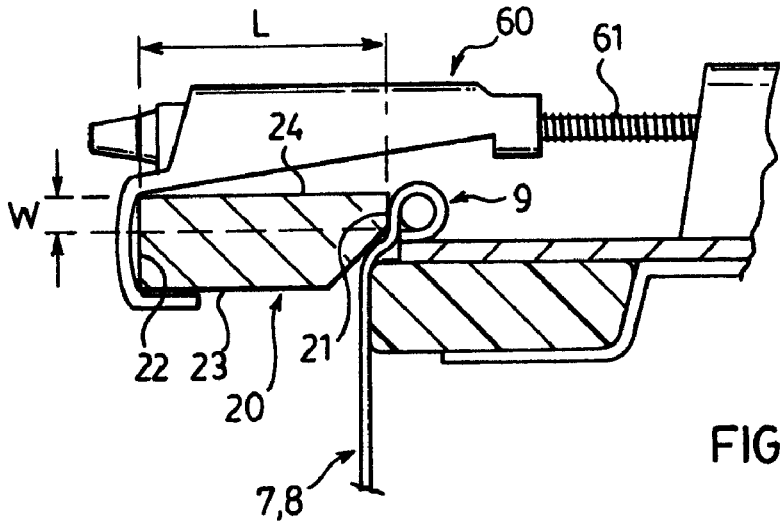
FIG. 4b.
FIG. 7.
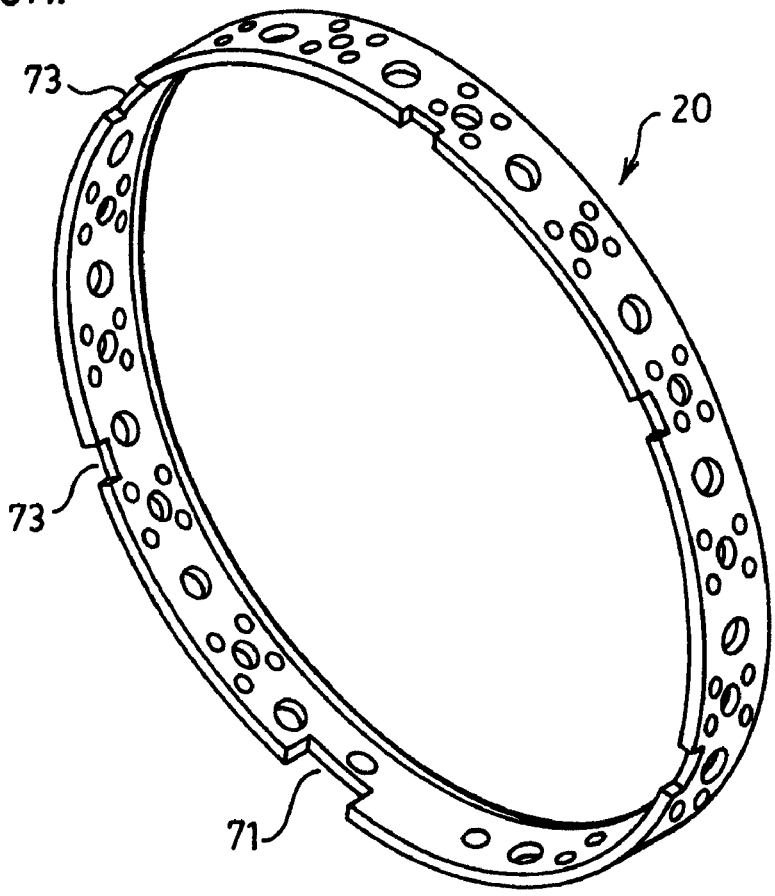

BASS DRUM SUPPORT SYSTEM

FIELD OF THE INVENTION

The present invention relates to a drum, and more particularly to a drum support system for supporting drums and drum accessories on a bass drum.

BACKGROUND OF THE INVENTION

Typically, bass drums are a component of drum kit systems and are placed near the floor with the drum head facing the drummer. Drum kits typically also include several tom-tom drums, usually smaller than the bass drum placed above the bass drum with the drum face upward. A snare drum, cymbals and other accessories may also be used and placed around the bass drum and toms.

In typical bass drums, one or two drum hoops are employed to engage the drum head(s) to hold the drum head in tension across drum shell. Commonly drum hoops are held in place with tensioners that apply a force on the drum hoop parallel to the axis of the drum hoop and drum shell.

The drum hoops convert the point forces applied by tensioners, usually 6 or 8 spread around the circumference of the drum hoop, into a substantially uniform pressure about the periphery of the drum shell. By maintaining substantially uniform pressure the tension in the drum head is substantially uniform. Uniform tension is desirably as it leads to good tone in the drum head when struck.

With a drum hoop, when a radial force is applied to the bass drum or to the drum hoop, the drum and drum hoop can distort or flatten. This change in shape can affect the tension in the drum head and therefore the tone of the drum.

Typically, a bass drum supports the tom-tom drums using a support arm that is attached directly to the drum shell of the bass drum. Similarly, support feet can be attached to the drum shell of the drum to provide the bass drum with support and to prevent the drum from rolling. By placing weight, in the form of the tom-tom drums on the drum shell of the bass drum, these designs squeeze the bass drum and tend to affect the sound of the bass drum. Similarly, the pressure from the support feet on the drum shell of the bass drum can distort the sound of the bass drum.

In some arrangements, the tom-tom drums are supported above the bass drum using a stand support structure separate and apart from the bass drum. While not placing weight on the bass drum, this design has the potential for the tom-tom drums and bass drum to separate as they are struck by the drummer. Further, it may be difficult for the tom-tom drums to be placed directly over the bass-drum if a separate support structure has to be used.

It would be advantageous to have a means for supporting one or more percussive instruments above a bass drum without applying weight or pressure to the shell of the bass drum.

BRIEF DESCRIPTION OF THE DRAWINGS

In drawings which illustrate by way of example only a preferred embodiment of the invention.

FIGS. 4*a* and 4*b* are alternative cross section views of the support hoop clamp showing the drum membrane and drum shell taken along section B-B in FIG. 3.

FIG. 5 is a cross section of the bass drum through the cylindrical body along section A-A in FIG. 3.

FIG. 7 is a perspective view of a batterhead side support hoop.

DETAILED DESCRIPTION OF THE INVENTION

Figure 1:
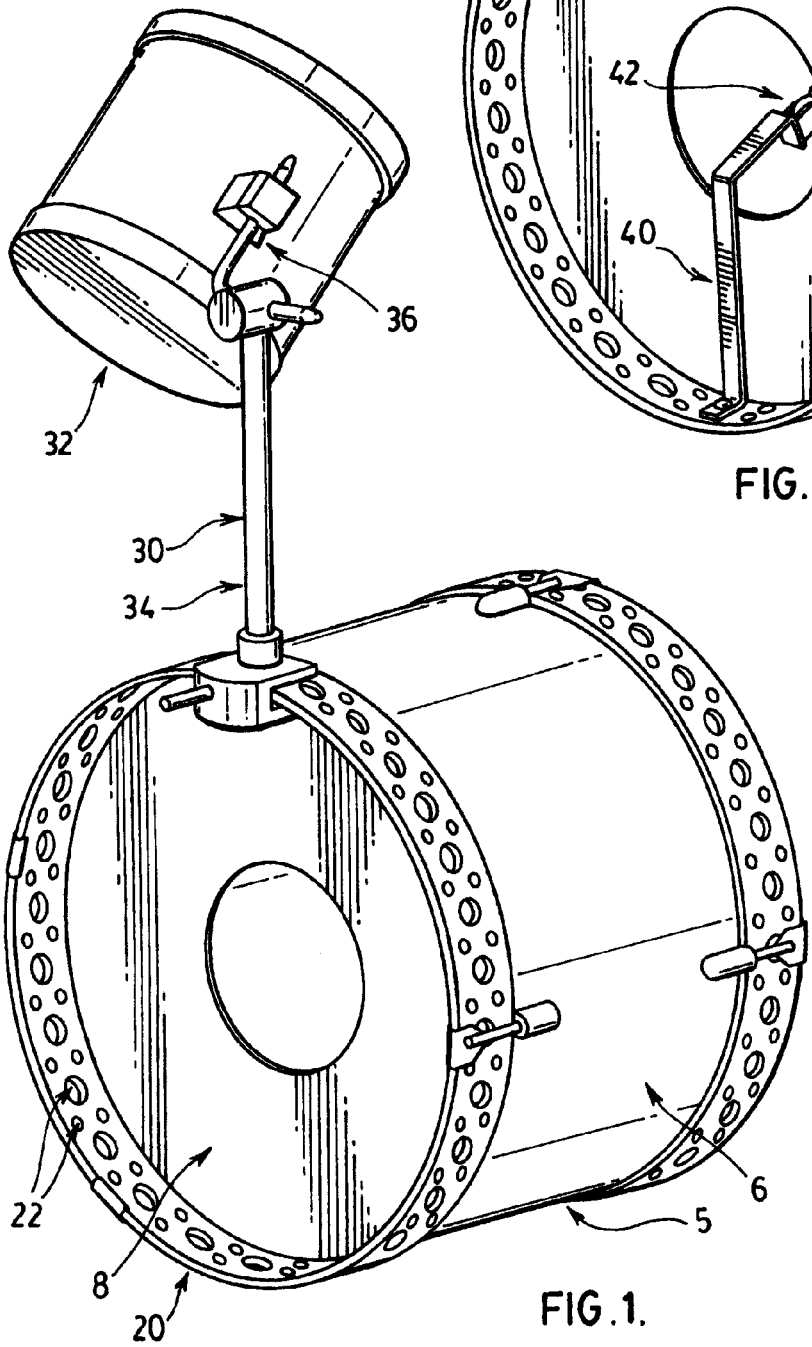
FIG. 1 is a perspective view of the single-hoop embodiment in accordance with the present invention showing a bass drum, the single-hoop, a tom-tom drum support and a single tom-tom drum.

In accordance with one aspect of the invention, there is provided a bass drum assembly comprising a cylindrical body including a front opening, a rear opening and a resonance chamber defined by the walls of the body, a front hoop engaged about the front portion of the cylindrical body, the rear hoop securing a membrane over the front opening, a rear hoop engaged about the rear portion of the cylindrical body, the rear hoop securing a membrane over the rear opening and providing one or more mounting locations, a support structure attached to one of the one or more mounting locations, one or more drums attached to the support structure, whereby the rear hoop supports the support structure and one or more drums above the cylindrical body while securing the membrane over the rear opening.

In accordance with another aspect of the invention, there is provided a bass drum assembly comprising a cylindrical body including a front opening, a rear opening and a resonance chamber defined by walls of the cylindrical body, a front hoop engaged about the front opening of the cylindrical body securing a membrane over the front opening, the front hoop containing one or more mounting locations external to the resonance chamber, a rear hoop engaged about the rear opening of the cylindrical body securing a membrane over the rear opening, the rear hoop containing one or more mounting locations external to the resonance chamber, a connecting means connecting the rear hoop to the front hoop mounted using one or more of the one or mounting locations on the rear hoop and one or more of the one or more mounting locations on the front hoop, a support structure attached to the connecting means, one or more drums attached to the support structure, whereby, the front hoop and rear hoop support the connecting means, the support structure and the one or more drums above the cylindrical body, In a further aspect, there is provided a bass drum support hoop, the hoop comprising: an inward face, an outward face, a front edge, and a drum head edge adapted to engage a drum head; the hoop adapted to receive a plurality of tensioners opposite the drum head edge and at least one percussive instrument support for mounting at least one percussive instrument; the hoop capable of supporting the at least one percussion instrument above the outward face; whereby when the hoop is tensioned by the tensioners attached to a bass drum shell to apply pressure to the drum head positioned across the bass drum shell and in contact with the drum head edge, the hoop is capable of supporting the at least one percussive instrument support, and the at least one percussive instrument mounted on the support and positioned above the outward face of the hoop, while maintaining substantially uniform axial pressure against the drum head and not applying substantial radial pressure against the drum shell.

In a further aspect, there is provided a support assembly for supporting at least one percussive instrument above a bass drum shell, the assembly comprising a resonant drum head hoop having an inward face, an outward face, a front edge, and a resonant drum head edge adapted to engage a resonant drum head, a batterhead drum head hoop having an inward face, an outward face, a front edge, and a batterhead drum head edge adapted to engage a batterhead drum head, the hoops adapted to receive a plurality of tensioners opposite the resonant drum head edge and the batterhead drum head edge, and a support rack for connecting to the resonant drum head hoop and the batterhead drum head hoop and supporting at least one percussive instrument support and at least one percussive instrument mounted on the support, whereby when the resonant drum head hoop is tensioned to the resonant drum head and the batterhead drum head hoop is tensioned to the batterhead drum head across the bass drum shell, and the support rack is connected to the hoops and supports the at least one percussive instrument support and the at least one percussive instrument mounted on the support above the bass drum shell, the assembly is able to support the at least one percussive instrument while maintaining substantially uniform axial pressure against about the resonant drum head edge and batterhead drum head edge and not applying substantial radial pressure against the drum shell In a further aspect, there is provided a method for supporting at least one percussive instrument with a bass drum, the method comprising placing a resonant drum head support hoop over a resonant drum head across the drum shell, tensioning the a resonant drum head support hoop onto the a resonant drum head with a plurality of tensioners located around a periphery of the drum shell, and mounting at least one percussive instrument to the resonant drum head support hoop above the drum shell, whereby the resonant drum support hoop is capable of supporting the at least one percussive instrument during operation while maintaining substantially uniform axial pressure to the resonant drum head and not applying substantial radial pressure against the drum shell.

In a further aspect, there is provided a method for supporting at least one percussive instrument with a bass drum, the method comprising: placing, a resonant drum head support hoop over a resonant drum head across the drum shell and tensioning the a resonant drum head support hoop onto the a resonant drum head with a plurality of tensioners located around a periphery of the drum shell; placing a batterhead drum head support hoop over a batterhead drum head across the drum shell and tensioning the batterhead drum head support hoop onto the batterhead drum head with a plurality of tensioners located around a periphery of the drum shell; and, mounting, at least one percussive instrument to the resonant drum head support hoop above the drum shell and the batterhead drum head support hoop above the drum shell; whereby the batterhead drum support hoop and the resonant drum support hoop are capable of supporting the at least one percussive instrument during operation while maintaining substantially uniform axial pressure to the batterhead drum head and the resonant drum head and not applying substantial radial pressure against the drum shell.

There are two preferred embodiments of the present invention that will be described in the following section; a single support hoop embodiment, and a double support hoop embodiment. In contrast to the prior art, the support hoop of the present invention provides structural support for supporting at least one percussive instrument above a bass drum.

Referring to FIG. 1, the bass drum 5 has a drum shell 6, and two drum heads 7, 8. One of the drum heads is the resonant drum head 8 that typically faces an audience. The resonant drumhead 8 may contain an opening for resonance purposes. The other of the two drum heads, not shown in FIG. 1, is the batterhead drum head 7 that faces the drummer.

In a first preferred embodiment, a bass drum support hoop 20 is engaged with the drum shell 6 and tensions the resonant drum head 8 around an opening of the drum shell 6. The support hoop 20 may comprise one or more mounting locations, such as a mounting hole, not shown, for mounting a percussive instrument. A typical drum hoop is sized and of sufficient strength to apply substantially uniform axial pressure to a drum head. Support hoop 20 is sized and of sufficient strength to both apply uniform axial pressure to a drum head and to receive and support radial pressure in the form of supporting at least one percussive instrument.

Figure 2:
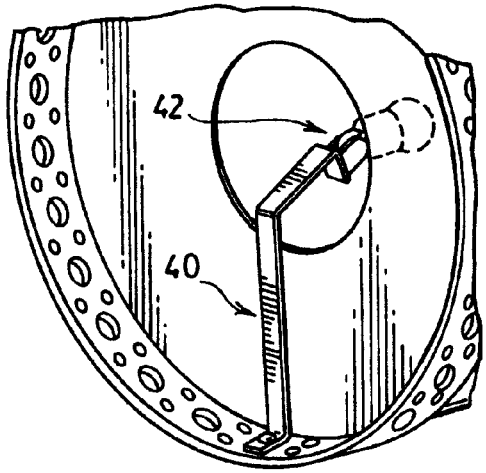
FIG. 2 is a perspective view of part of the single-hoop embodiment in accordance with the present invention showing a bass drum, the single-hoop and a microphone support structure.

Referring to FIG. 2, the support hoop 20 may be used to mount other accessories, including a microphone support structure 40 and microphone 42.

In this description, the term "single-hoop" refers to an embodiment of a bass drum that contains two drum hoops, but only one of which is reinforced to provide the structure to support drum kit accessories as described above. In such an embodiment, the hoop at the opposite end of the drum is of conventional design.

Figure 3:
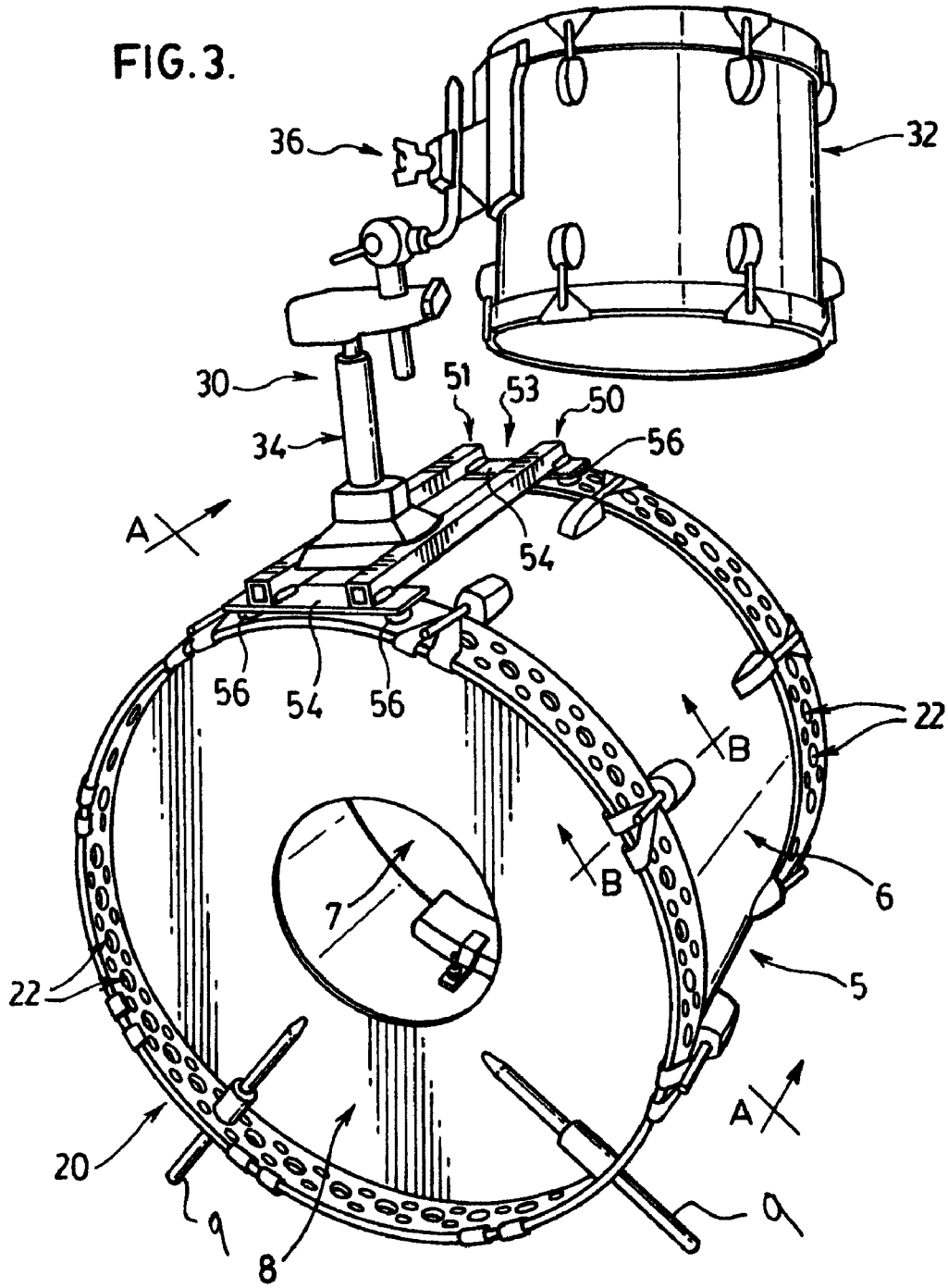
FIG. 3 is a perspective view of the double-hoop embodiment in accordance with the present invention, showing a bass drum, the double-hoop, a tom-tom support structure and a single tom-tom drum.

Referring to FIG. 3, the double-hoop embodiment of the invention consists of a bass drum with support hoops 20, 24 at both ends of the drum shell 6. The resonant drum head support hoop 20 is tensioned to the drum shell 6 to apply pressure to the resonant drum head 8 across the drum shell 6. Similarly, the batterhead drum head support hoop 24 is tensioned to the drum shell 6 to apply pressure to the batterhead drum head 7 across the drum shell 6.

The resonant drum head support hoop 20 and batterhead drum head support hoop 24 provide the support to one or more percussive instrument support structures, such as a rack 53 for supporting one or more percussive instrument supports 30 and one ore more percussive instruments mounted to the one or more percussive instrument supports 30, such as a tom drum 32.

Figure 6A:
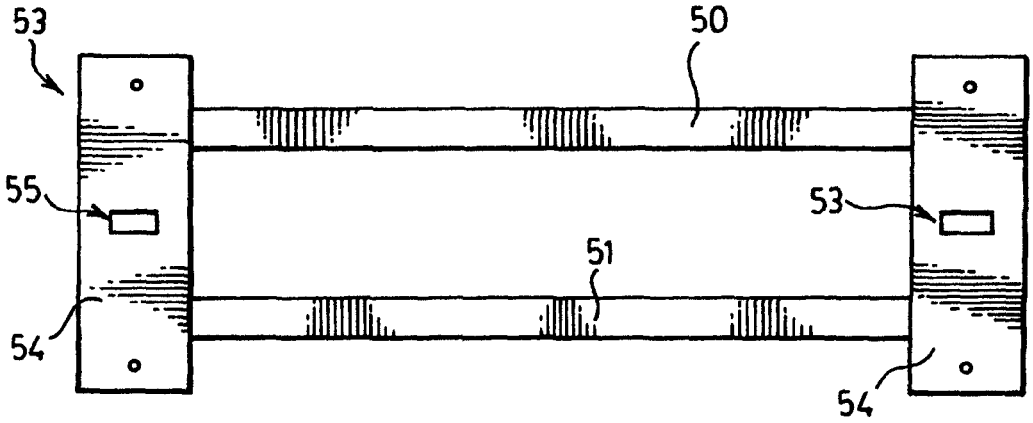
FIGS. 6*a*-6*c* are top, side and bottom views of a support rack.
Figure 6B:
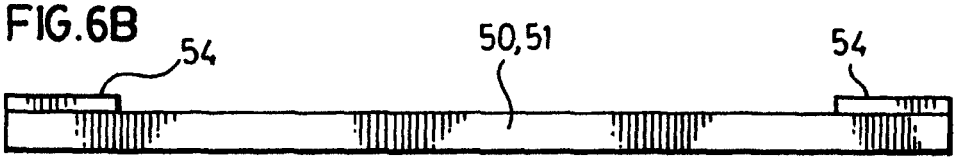
Figure 6C:
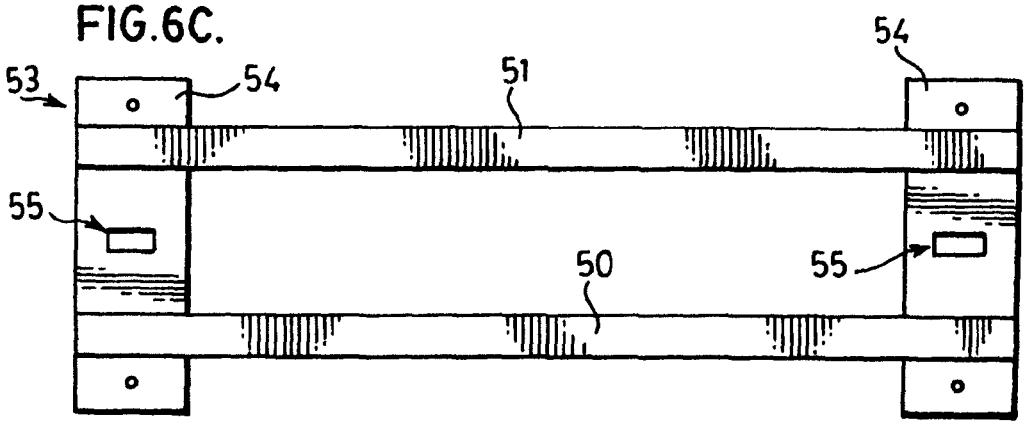

In an embodiment, a rack 53 may be provided comprised of rigid connecting members 50, 51 mounted on a pair of plates 54 as illustrated in FIGS. 3 and 6. Referring to FIG. 6, preferably the plates 54 comprise slots 55 for receiving a connecting means to affix the plates 54 to the support hoops 20, 24. Slots 55 are preferred over holes in order to allow the rack 53 to accommodate different brands of bass drum shells 6. This preferable adaptation is useful where the rack 53 is intended to be used with different brands of bass drum shell 6. The rack 53 depicted in FIG. 3 is illustrated in isolation in FIGS. **6*a*-6*c***.

As will be appreciated, though nominally the same dimension, different drum manufacturers will commonly manufacture their drum shells 6 to be of slightly different axial length. The provision of slots 55 allows for a rack 53 to be employed with a variety of drum shell 6 lengths. Other methods of accommodating different size bass drums including providing a slot in the support hoops 20, 24 and providing an adjustable connecting means such as a clamp or threaded connector that is able to adapt to a different length drum shell 6. As illustrated in FIG. 3, rubber mounts 56 may be provided to engage with the outward face of the support hoop 20, 24.

The rigid connecting members 50, 51 connect to the resonant drum head support hoop 20 and batterhead drum head support hoop 24 and provide a stable support above the bass drum 5. One or more percussive instrument supports 30 and one or more percussive instruments such as a torn drum 32 may be conveniently mounted on the rigid connecting members 50, 51 using standard fittings, As will be appreciated, the rigid connecting members 50, 51 provide a convenient and stable support that permits axial adjustment of the location of the one or more percussive instrument supports 30 either toward or away from the drummer's playing position.

As an alternative to a pair of connecting members 50, 51 a single connecting member may be used provided it is shaped to accommodate a percussive instrument support 30 and is sufficiently rigid to support one or more percussive instrument supports 30 and one or more percussive instruments.

As mentioned above, a variety of means can be used to support the one or more percussive instruments, such as a tom drum 32 above the rack 53. In a preferred embodiment, a vertical arm 34 has one or more brackets 36 attached to the side walls of a tom drum 32.

In use, the weight of the tom drum 32, including the forces applied by the drummer when striking the tom drum 32, the weight of the percussive instrument support 30 and the weight of the rack 53, is applied to the resonant drum head support hoop 20 and batterhead drum head support hoop 24. The support hoops are sufficiently stiff to withstand the expected forces from the one or more percussive instruments such that the forces are not applied to the drum shell 6 of the bass drum 5 and the support hoops 20, 24 maintain substantially uniform pressure to the drum heads 7, 8.

As mentioned above, the position of the one or more percussive instruments may be changed by adjusting the position of the percussive instrument support 30 mounted on the rack 53, as well as by adjusting the percussive instrument support 30 itself. In this way the one or more percussive instruments may be positioned above the bass drum 5 in a variety of convenient locations for playing while maintaining a stable mounting above the bass drum 5.

Also illustrated in FIG. 3 are feet 9 which may optionally be provided. Typical bass drums include slots through the shell to accommodate adjustable feet. As illustrated, the feet 9 may be located on the hoop 20 with height adjustment through a slot or hole through the wall of the hoop. Accordingly, the drum shell need not include slots or holes to accommodate feet. Furthermore, the weight applied to the hoop 20 may be directly applied to the floor through the outer wall of the hoop 20 and the feet 9.

Referring to FIGS. 4*a* and 4*b*, a section view along line BB in FIG. 3, a support hoop 20 maintains a drum head 7, 8 across an opening of the drum shell 6. Tensioners 60 apply pressure to the support hoop 20, which in turn presses against a bead 9 around the periphery of the drum head 7, 8 to maintain tension in the drum head 7, 8. As will be understood to someone skilled in the art, tensioners 60 are typically bolted around the peripheries of both ends of the drum shell 6 to apply tension to the drum heads 7, 8. FIG. 4*b* illustrates an alternate embodiment where a support hoop 20 thicker than the width w to engage the bead 9 is accommodated b including a chamfer at the end of the support hoop 20 that engages the bead 9.

FIG. 5, a section view along line AA in FIG. 3, illustrates the distribution of tensioners 60 about the periphery of a drum shell 6. In the example illustrated 6 tensioners 60 are illustrated by way of example only.

A bass drum support hoop 20 is a drum hoop but has the additional features of providing a substantially uniform axial pressure to the drum head 7, 8, maintaining it in tension around the drum shell circumference and not applying substantial radial pressure to the drum shell 6 while a radial force is applied to the drum support hoop 20 by tensioners 60. In other words, the support hoop 20 is sufficiently strong and rigid so that radial force applied to the support hoop 20 from at least one percussive instrument does not deform or deflect the support hoop 20 such that axial pressure applied to the drum head 7, 8 would no longer be substantially uniform or the support hoop 20 would impart a significant radial force to the drum shell 6. Accordingly the weight of the least one percussive instrument is borne by the support hoop 20, and not the drum shell 6.

A tom-tom drum support structure 30 may be mounted to the support hoop 20 at a convenient mounting location. Typically a support structure 30 will be mounted central to the drum shell 6 for convenience and stability. The support structure 30 may support one or more percussive instruments, such as tom-tom drums 32 above the bass drum shell 6. A variety of means can be used to connect the support structure 30 to the tom-tom drums 32 which are known in the prior art. In a preferred embodiment, a vertical arm 34 has one or more brackets 36 attached to the side walls of one or more tom-tom drums 32.

The weight of the tom-tom drum 32, including the forces applied by the drummer when striking the tom-tom drum 32, is applied to the support hoop 20. The support hoop 20 is sufficiently stiff to withstand the expected forces from the tom-tom drum 32.

A bass drum support hoop 20, 24 may be conveniently be formed from a hoop of stock material, such as a metal or composite material. In a preferred embodiment the hoop comprises an aluminum hoop. In an alternate preferred embodiment the hoop comprises a carbon fibre hoop.

As will be appreciated the specific dimensions of a hoop 20 are adapted to provide sufficient support for the expected weight of percussive instruments to be supported, its diameter as well as the strength of materials employed. It has been found that aluminum provides a convenient material for constructing a support hoop 20, 24. In one embodiment an aluminum hoop may be of uniform thickness with the drum head edge adapted, for instance by rounding the edges, to interface with a bead 9 of a drum head 7, 8. When using an Aluminum hoop of constant thickness it is preferable to add weight reduction holes 22 through the inward and outward faces of the hoop. A constant thickness hoop is convenient as metal hoops are commonly constructed in this manner, providing a readily available stock of material.

FIG. 7 illustrates an embodiment of a relatively thick hoop 20. In the embodiment illustrated, a batterhead support hoop 20 may comprise an aluminum hoop that is relatively wide axially relative to its thickness radially. The thickness of the support hoop 20 may be selected to be comparable to the thickness of a standard drum hoop, and appropriate to engage with a bead 9 of a drum head 7, 8. In such an embodiment, the axial width is substantially larger than the axial width of a standard drum hoop. Accordingly, as illustrated in FIG. 7, a channel or slot 71 should be removed from a portion of its front edge in order to accommodate a kick pedal. Preferably a rubber insert may be provided around or near the channel or slot to provide a suitable surface to engage with the kick pedal.

Figure 8:
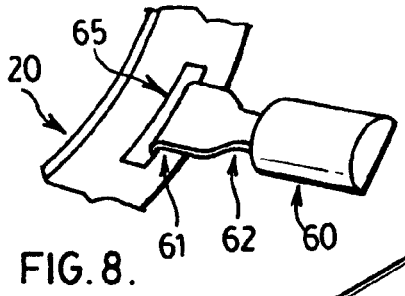
FIG. 8 is a perspective view of an alternative clamping embodiment.

Also illustrated in FIG. 7, are notches or slots 73 to receive tensioner hooks 61 and assist with alignment. Slots 73 are an alternate arrangement to slots 65 illustrated in FIG. 8.

Also illustrated in FIG. 7 are holes through the hoop 20. The holes are provided to reduce the weight of the hoop. The holes illustrated may not be required depending upon the dimensions and weight of the hoop 20 selected.

Also illustrated in FIG. 7 is a cross-section of the hoop 20 showing a chamfer in the hoop profile. The use of a chamfer is useful to allow the hoop 20 to engage a bead 9 where the thickness of the hoop 20 is greater than that of a standard drum hoop. This alternate embodiment provides a relatively thick hoop (radially) with a drum head edge of reduced thickness to engage the bead 9 of a drum head 7, 8. Other variations are contemplated provided the hoop is of sufficient rigidity such that radial force applied to the hoop from at least one percussive instrument does not deform or deflect the hoop such that axial pressure applied to a drum head 7, 8 would no longer be substantially uniform or the hoop would impart a significant radial force to a drum shell 6.

In a further alternate embodiment a composite hoop, such as a carbon fibre hoop, may be constructed to be of sufficient rigidity such that radial force applied to the hoop from at least one percussive instrument does not deform or deflect the hoop such that axial pressure applied to a drum head 7, 8 would no longer be substantially uniform or the hoop would impart a significant radial force to a drum shell 6. A composite hoop would likely require specific reinforced mounting locations to accommodate one or more percussive instrument supports 30.

For both the single-hoop and double-hoop embodiments, a preferred embodiment uses additional holes or slots in the support hoop 20, 24 to improve the compatibility of the support hoop 20, 24 with conventional tensioner 60 designs. As can be seen in FIG. 4, the tensioners 60 commonly hook over a drum hoop or drum support hoop 20, 24 using a tensioner hook 61 and maintain pressure on the hoop 20, 24. With a drum support hoop 20, 24, the hoop is typically thicker in the axial direction which may interfere with the general tensioner 60 design. In an embodiment, a lengthened tensioner is used to engage the drum support hoop using a shaft 62 that is longer than a standard tensioner shaft. In an alternate embodiment, illustrated in FIG. 8 a slot 65 is made in the drum support hoop 20, 24 to allow standard tensioners 66 to engage the support hoop 20, 24 through a wall of the hoop 20.

Figure 9:
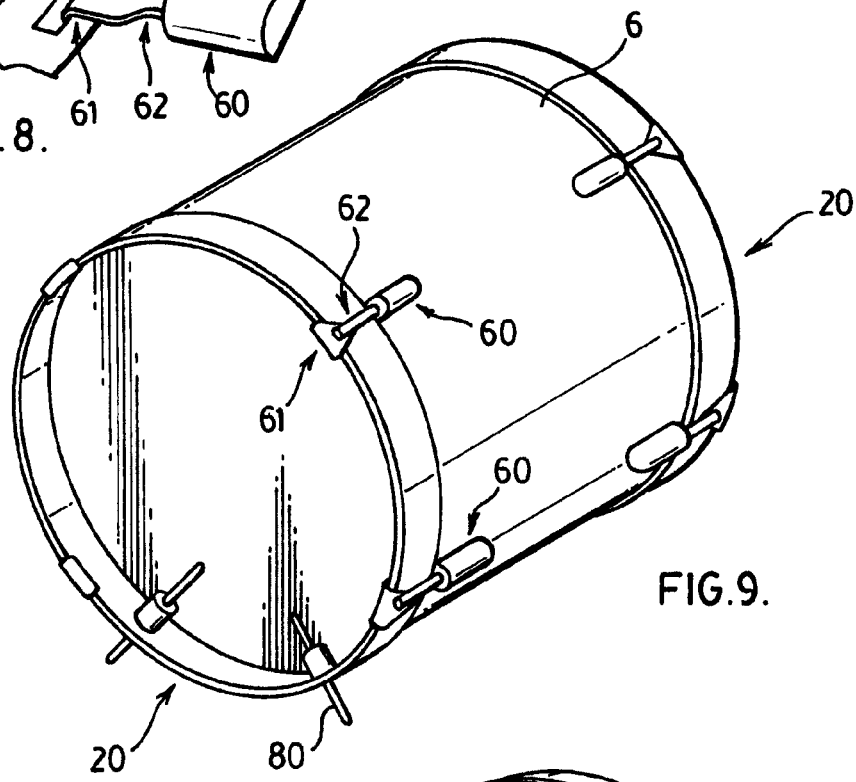
FIG. 9 is a perspective view of an embodiment from the batterhead side.
Figure 10:
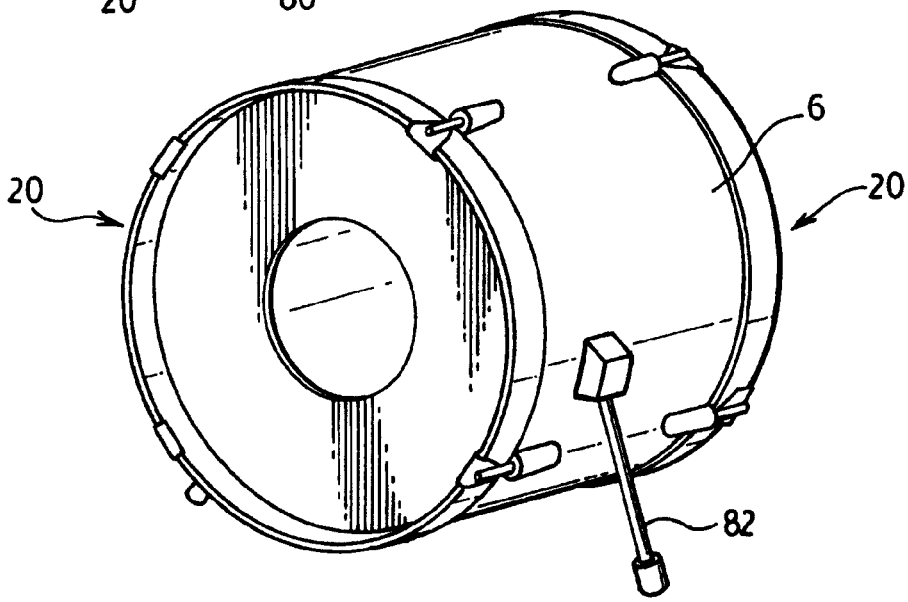
FIG. 10 is a perspective view of an embodiment from the resonant head side.

FIGS. 9 and 10 illustrate an embodiment of a dual-hoop system without the rack 53 illustrated for clarity. In the embodiments illustrated the hoops are provided without weight-reducing holes, as described above. As illustrated in the embodiment of FIG. 9, feet 80 may preferably be located through the hoop 20 to avoid locating supports 82 through the drum shell 6. The location of feet 80 on the hoop 20 further reduces the load on the shell 6.

Figures 11A, 11B:
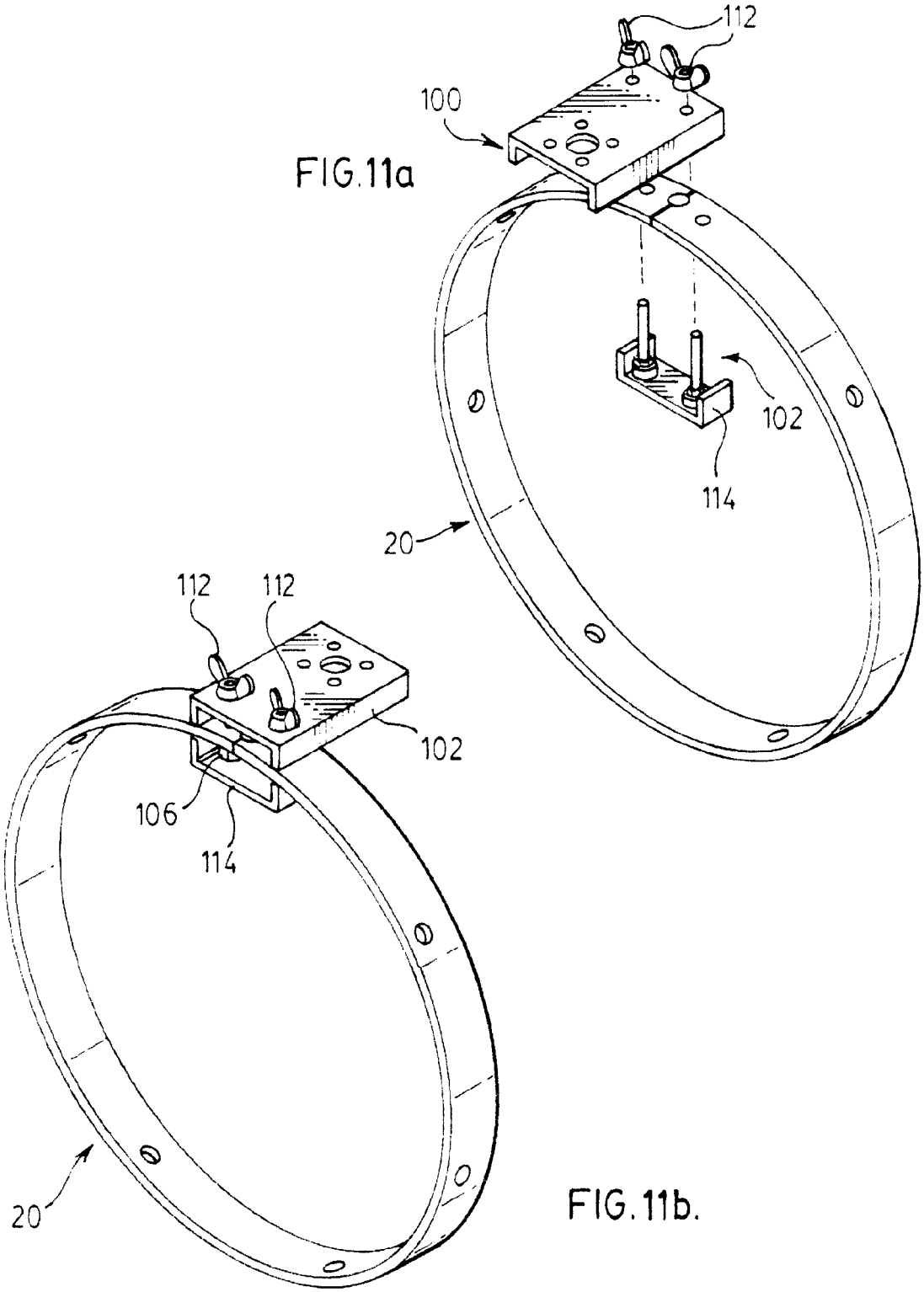
FIGS. 11*a* and 11*b* are perspective views of an offset support for a single hoop embodiment.

FIGS. 11*a* and 11*b* illustrate an embodiment of a single hoop system including an offset support 100 for mourning vertical arm 34 (not shown in this figure) closer to the batterhead drum head 7 that faces the drummer. Depending upon the depth of the drum shell 6 and the arrangement of toms 32 on the drum shell 6, it may be desirable to locate the mounting of the vertical arm 34 towards the center of the drum shell 6. The offset support 100 may also include multiple mounting locations, for instance by using slots, to allow for adjustment of the location of vertical arm 34.

Figure 12A:
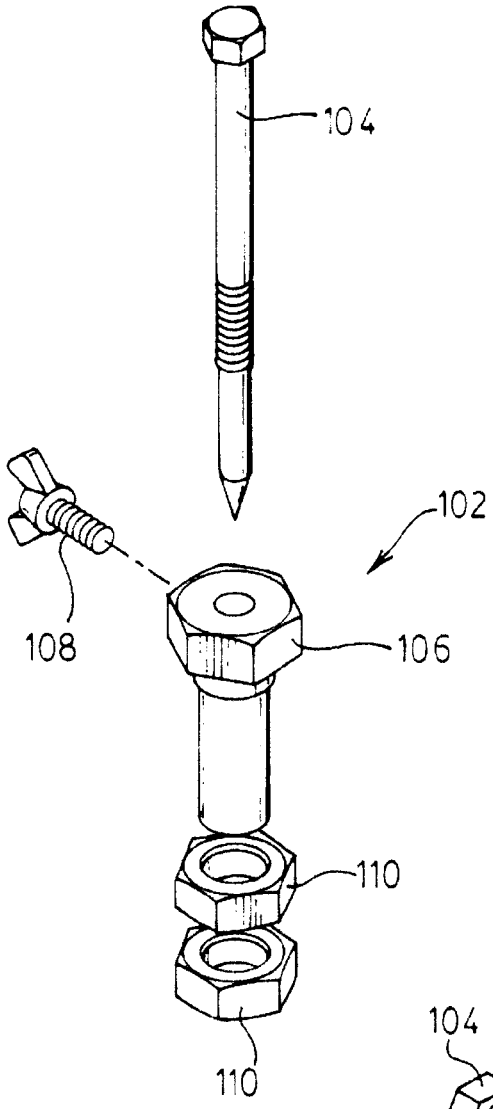
FIGS. 12*a* and 12*b* are views of an embodiment of a threaded lock for securing the offset support of FIGS. 11*a* and 11*b*.
Figure 12B:
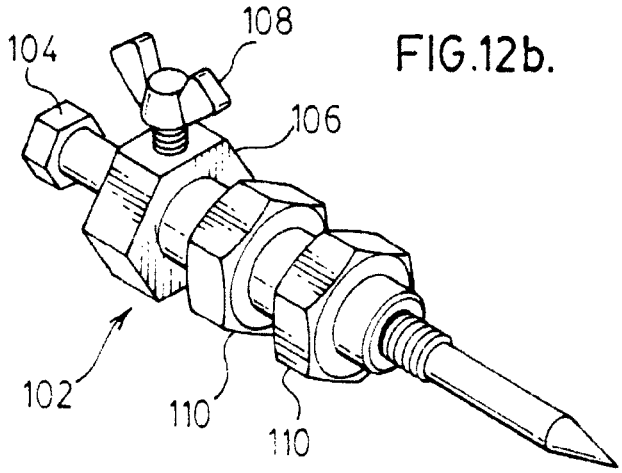

FIGS. 12*a* and 12*b* illustrate an embodiment of a threaded lock 102 that may be used to secure the offset support 100 to the hoop 20. The threaded lock 102 is comprised of a threaded member 104, a spacer 106, a spacer lock 108 to fix the spacer 106 on the threaded member 104, and locking nuts 110 to lock the threaded member 104 and spacer 106 in place around a bracket 114. The full assembly illustrated in FIG. 11*a* may be secured in place with wing nuts 112 or other securing means.

I claim:

1. A bass drum support hoop, the hoop comprising:

an inward face, an outward face, a front edge, and a drum head edge adapted to engage a drum head;

the hoop adapted to receive a plurality of tensioners opposite the drum head edge and at least one percussive instrument support for mounting at least one percussive instrument;

the hoop capable of supporting the at least one percussive instrument above the outward face;

whereby when the hoop is tensioned by the tensioners attached to a bass drum shell to apply axial pressure to the drum head positioned across the bass drum shell and in contact with the drum head edge, the hoop is capable of supporting the at least one percussive instrument support, and the at least one percussive instrument mounted on the support and positioned above the outward face of the hoop, while maintaining substantially uniform axial pressure against the drum head and not applying substantial radial pressure against the drum shell.

2. The bass drum support hoop of claim 1 wherein the drum head is a resonant drum head and wherein the hoop is capable of supporting the at least one percussive instrument beyond the drum head edge and above the bass drum shell.

3. The hoop of claim 1 wherein the drum head edge is adapted to engage a resonant drum head.

4. The hoop of claim 3 wherein the hoop receives the tensioners at the front edge.

5. The hoop of claim 1 further comprising:

a plurality of openings about the hoop extending from the outward face to the inward face, each opening adapted to receive a tensioner;

whereby the hoop receives the tensioners through the openings.

6. A support assembly for supporting at least one percussive instrument above a bass drum shell, the assembly comprising:

a resonant drum head hoop having an inward face, an outward face, a front edge, and a resonant drum head edge adapted to engage a resonant drum head;

a batterhead drum head hoop having an inward face, an outward face, a front edge, and a batterhead drum head edge adapted to engage a batterhead drum head;

the hoops adapted to receive a plurality of tensioners opposite the resonant drum head edge and the batterhead drum head edge; and, a support rack for connecting to the resonant drum head hoop and the batterhead drum head hoop and supporting at least one percussive instrument support and at least one percussive instrument mounted on the support;

whereby when the resonant drum head hoop is tensioned to the resonant drum head and the batterhead drum head hoop is tensioned to the batterhead drum head across the bass drum shell, and the support rack is connected to the hoops and supports the at least one percussive instrument support and the at least one percussive instrument mounted on the support above the bass drum shell, the assembly is able to support the at least one percussive instrument while maintaining substantially uniform pressure about the resonant drum head edge and batterhead drum head edge.

7. A method for supporting a bass drum comprising the steps of:

a) engaging a first bass drum support hoop with a bass drum shell and a first drum head to tension substantially evenly the first drum head, b) engaging a second bass drum support hoop with the bass drum shell and a second drum head to tension substantially evenly the second drum head, c) connecting the first and second bass drum support hoops using a rigid connecting means, and, d) mounting at least one percussive to the rigid connecting means above the drum shell, whereby, the first and second bass drum support hoops are capable of supporting the at least one percussive instrument during operation while maintaining substantially uniform tension to the first and second drum heads.

8. A method for supporting at least one percussive instrument with a bass drum, the method comprising:

a) placing a resonant drum head support hoop over a resonant drum head across the drum shell;

b) tensioning the a resonant drum head support hoop onto the a resonant drum head with a plurality of tensioners located around a periphery of the drum shell; and, c) mounting at least one percussive instrument to the resonant drum head support hoop above the drum shell;

whereby the resonant drum support hoop is capable of supporting the at least one percussive instrument during operation while maintaining substantially uniform pressure to the a resonant drum head.

9. The method of claim 8 further comprising:

a) placing a batterhead drum head support hoop over a batterhead drum head across the drum shell;

b) tensioning the batterhead drum head support hoop onto the batterhead drum head with a plurality of tensioners located around a periphery of the drum shell; and, c) further mounting the at least one percussive instrument to the batterhead drum head support hoop above the drum shell;

whereby the batterhead drum support hoop and the resonant drum support hoop are capable of supporting the at least one percussive instrument during operation while maintaining substantially uniform pressure to the batterhead drum head and the resonant drum head.

* * * * *